United States Patent [19]

Modica

[11] Patent Number: 5,076,405

[45] Date of Patent: Dec. 31, 1991

[54] COMBINATION CARRYING CASE AND BEACH ACCESSORY

[76] Inventor: Alfredo Modica, 1027 West 11th St., #3, San Pedro, Calif. 90731

[21] Appl. No.: 667,497

[22] Filed: Mar. 11, 1991

[51] Int. Cl.[5] ..... A45C 9/00

[52] U.S. Cl. ..... 190/1.0; 62/457.7; 297/192; 5/417; 5/419; 190/2; 190/8; 190/12 A

[58] Field of Search ..... 190/1, 2, 8, 12 A; 62/457.7, 530; 297/192, 193; 5/417, 418, 419, 420

[56] References Cited

U.S. PATENT DOCUMENTS

| | | | |
|---|---|---|---|
| 2,034,369 | 3/1936 | Bayer | 190/1 |
| 2,045,784 | 6/1936 | Leve | 190/1 |
| 2,427,230 | 9/1947 | Salzmann . | |
| 2,540,165 | 2/1951 | Fiel . | |
| 3,822,424 | 7/1974 | Messer | 5/419 |
| 4,164,275 | 8/1979 | Davis | 5/417 |
| 4,194,601 | 3/1980 | Yellin | 190/2 |
| 4,222,468 | 9/1980 | DeFries | 5/417 |
| 4,466,517 | 8/1984 | Spiegelman | 190/2 |
| 4,527,830 | 7/1985 | Meyers | 297/193 |
| 4,571,740 | 2/1986 | Kirby et al. . | |
| 4,634,618 | 1/1987 | Greer et al. | 5/417 |
| 4,671,393 | 6/1987 | Rainey | 190/1 |
| 4,679,242 | 7/1987 | Brockhaus | 190/1 |
| 4,681,195 | 7/1987 | Trahan et al. . | |
| 4,700,395 | 10/1987 | Long . | |
| 4,773,709 | 9/1988 | Slinkard . | |
| 4,841,587 | 6/1989 | Carter et al. . | |
| 4,913,318 | 4/1990 | Forrester | 297/193 |
| 4,939,912 | 7/1990 | Leonovich, Jr. . | |
| 4,942,948 | 7/1990 | Vickers | 190/1 |
| 4,980,935 | 1/1991 | Kazanowski et al. | 190/2 |

*Primary Examiner*—Stephen Marcus
*Assistant Examiner*—Chris McDonald
*Attorney, Agent, or Firm*—Kelly, Bauersfeld & Lowry

[57] ABSTRACT

A beach accessory includes a carrying case having a plurality of storage compartments, a flexible mat stored within one of the storage compartments and extendable through a side of the carrying case, and a cushion pivotally attached to the carrying case. The cushion is connected to the carrying case by a pair of hinges to be rotatable between a first position wherein the cushion lies atop an upper surface of the carrying case, and a second position wherein the cushion rests, at least partially, on or adjacent to a ground surface. In the first position the cushion provides a cover for the storage compartments and a seat for a user of the beach accessory. In the second position a cushion provides a pillow for a person lying upon the mat after it has been extended from the carrying case. The carrying case is configured to provide a portable table when inverted, and includes an alarm clock, a radio receiver and a cassette tape player.

18 Claims, 2 Drawing Sheets

FIG. 1
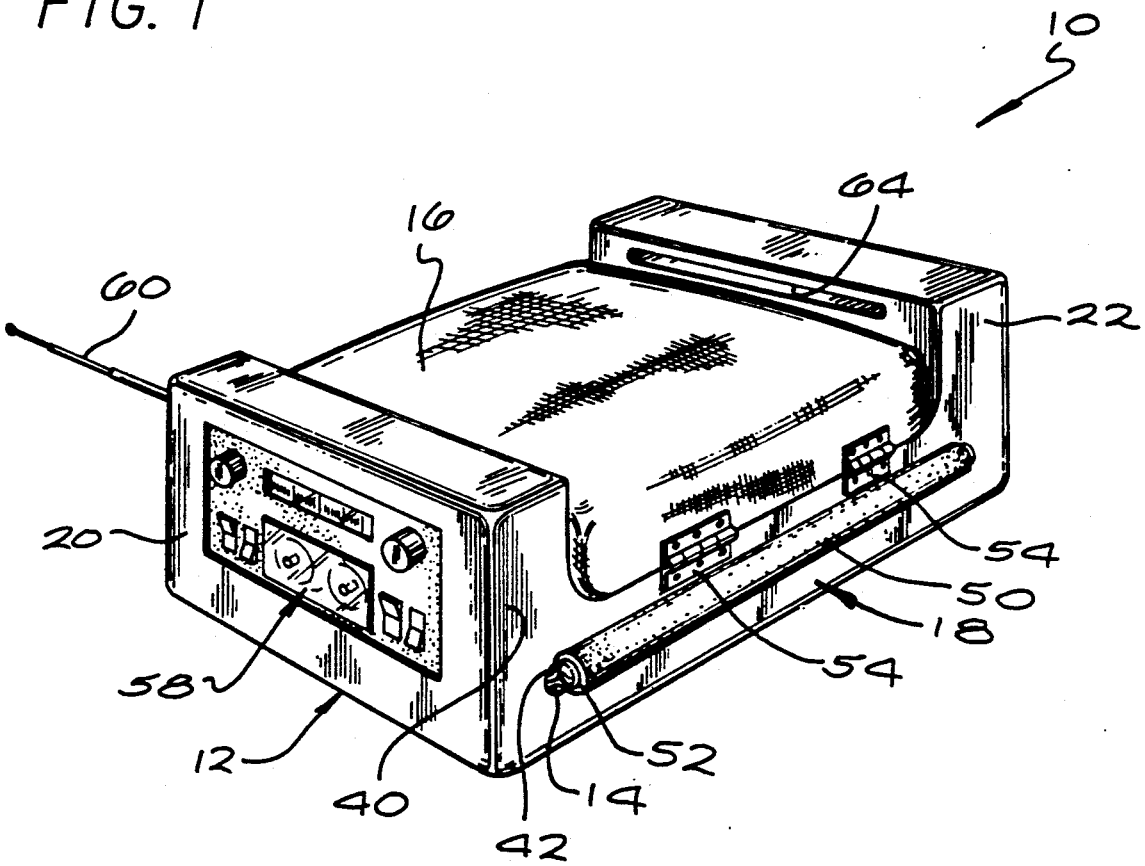
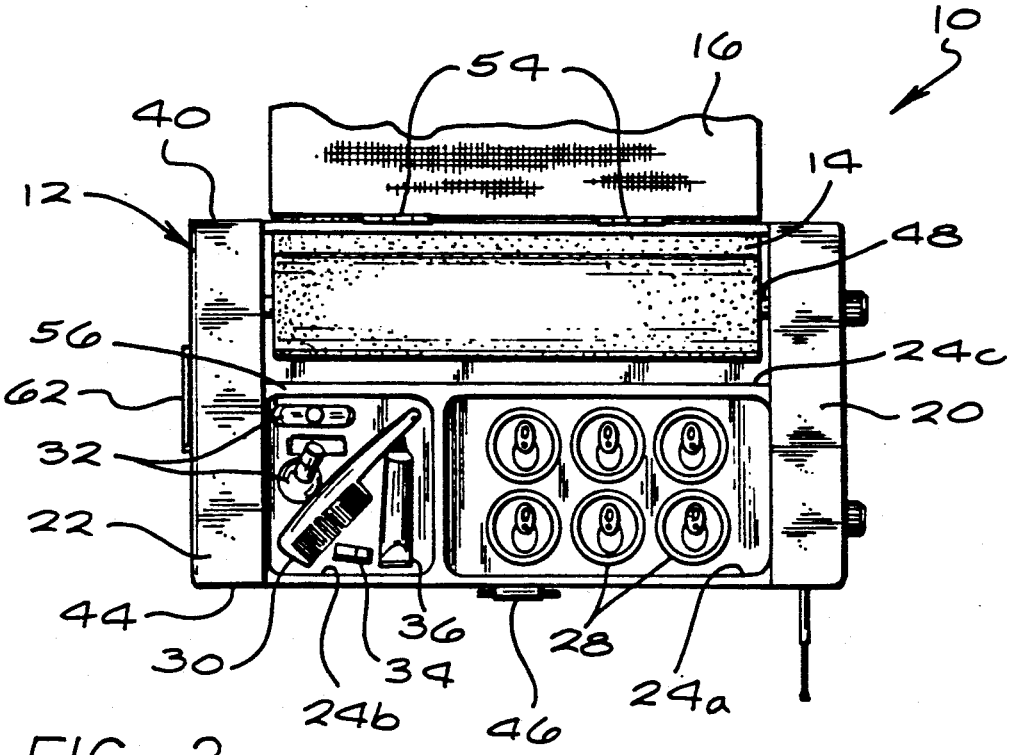
FIG. 2

FIG. 3
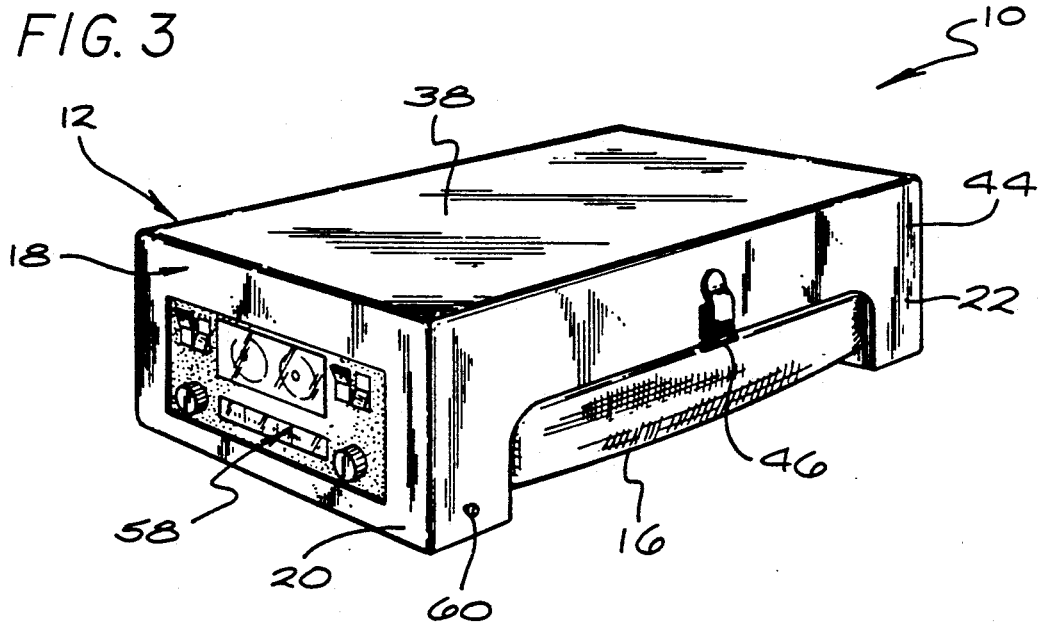
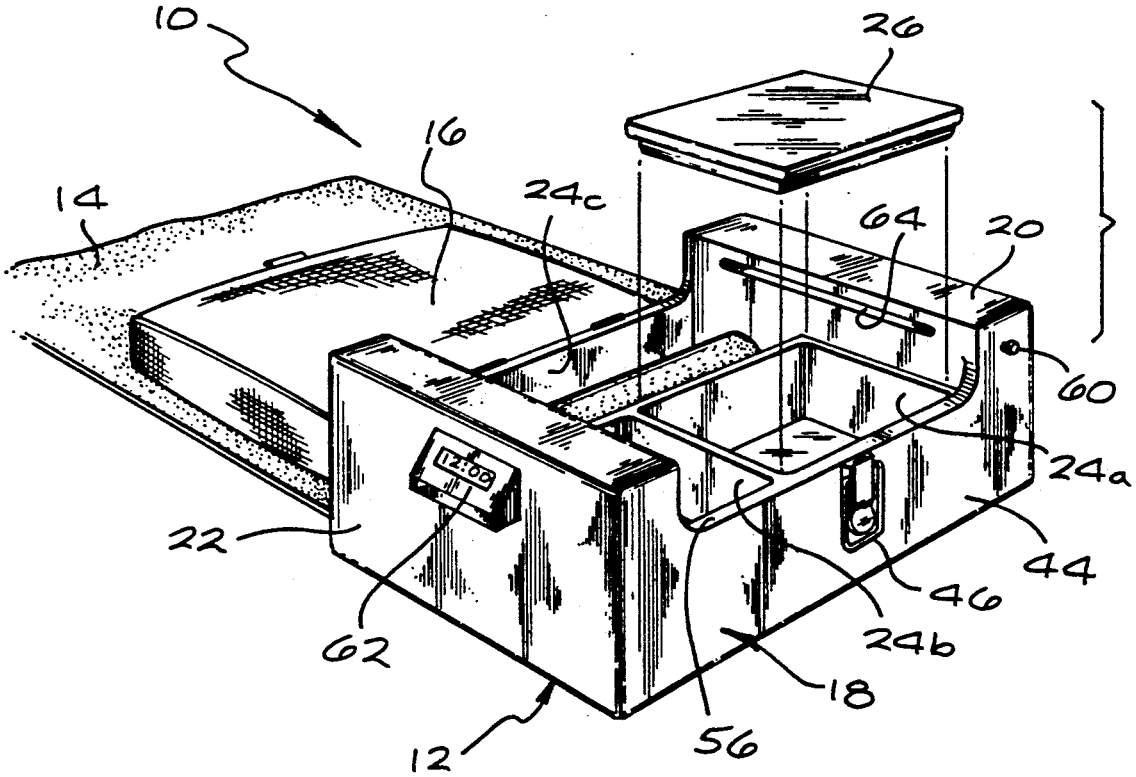
FIG. 4

COMBINATION CARRYING CASE AND BEACH ACCESSORY

BACKGROUND OF THE INVENTION

The present invention relates generally to lightweight carrying cases and coolers designed for recreational use. More specifically, the present invention relates to a combination carrying case and beach accessory which may be configured to provide a portable seat, portable table or a mat for sunbathing.

It is a favorite recreational activity of people of all ages to spend a day at the beach or park to sunbathe, swim, play games and otherwise enjoy the fresh air and sunshine. However, the trip to and from the beach and park may be quite another thing because of the difficulty in transporting all of the paraphernalia to be utilized in the day's activities. For example, a person may wish to carry a beach mat for sunbathing, towels, suntan lotions, sunglasses, changes of shoes and perhaps other clothing as well as sports and recreational equipment. Then, when the sunbather wishes to leave the beach mat, as to go swimming, it is desirable to have a relatively safe place to put items of jewelry as well as money, just as it is desirable to have such valuables out of view should one fall asleep while sunbathing.

Moreover, carrying food and beverage containers and other articles such as portable AM/FM radio or tape cassette recorders by hand to the location of the picnic or beach or other outdoor activity, often remote from access by vehicle, is frequently cumbersome and tiring. Portable coolers are generally available which are lightweight and convenient, as are portable AM/FM radios or tape cassette recorders. Nevertheless, it is difficult to carry separate coolers, radios, tape cassette players, and all of the other items which may be desired to a particular activity, where significant walking distances are involved. Additionally, many small items may become lost or stolen during transport, and it is often desirable to keep many of these items out of the sand at a beach.

Accordingly, there has been a need for a novel combination carrying case and beach accessory which can be produced economically, provides storage compartments for miscellaneous items such as combs and sunscreen, is lightweight for easy manual transport, and which has several uses. Such a novel combination should include music generation means, preferably in the form of a radio receiver and/or a tape cassette player. Additionally, a combination carrying case and beach accessory is needed which provides a cushion which a user can utilized as either a seat or a pillow, as desired. The present invention fulfills these needs and provides other related advantages.

SUMMARY OF THE INVENTION

The present invention resides in a beach accessory which combines the features of a lightweight portable carrying case with other items typically desirable to carry to a beach or picnic area. The beach accessory comprises, generally, a carrying case having at least one storage compartment, a flexible mat stored within the compartment and extendable through a side of the carrying case, and a cushion pivotally attached to the carrying case. The cushion is rotatable between a first position wherein it is configured, with the carrying case, to provide a seat for the user, and a second position wherein the cushion provides a pillow for the user.

In a preferred form of the invention, the carrying case includes a plurality of storage compartments which are each accessible through respective upper openings. At least one of the storage compartments is thermally insulated and is provided with a thermally insulated lid. The carrying case is generally U-shaped and includes laterally spaced, upwardly extending carrying handles between which the cushion is situated in its first position. The carrying handles provide table legs, and a base of the carrying case provides a table top when the beach accessory is inverted.

The flexible mat is stored within one of the storage compartments and is extendable therefrom through a slot provided in a first vertical side of the carrying case. The flexible mat, preferably in the form of a towel, is wound about a shaft. The shaft is rotatably positioned within the one storage compartment and includes spring loading means for self-winding the towel about the shaft within the selected storage compartment. The towel is provided with an enlarged end which is incapable of passing through the slot provided in the first vertical side of the carrying case.

The cushion is pivotally attached to the carrying case by means of a hinge fixed to one side of the cushion and to the first vertical side of the carrying case above the slot. In its first position, the cushion lies atop an upper surface of the carrying case to provide a cover for the plurality of storage compartments as well as a seat for the user of the beach accessory. In its second position, the cushion rests, at least partially, on or adjacent to a ground surface to provide a pillow for the user of the beach accessory. A clasp is provided on a second vertical side of the carrying case to lock the cushion into its first position.

An alarm clock is supported within a first upwardly extending carrying handle and is positioned adjacent to an exterior surface thereof. In like manner, music generation means are supported within a second upwardly extending carrying handle and positioned adjacent to an exterior surface thereof. The music generation means comprises, preferably, a radio receiver and a cassette tape player.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a top, front and left side perspective view of a combination carrying case and beach accessory embodying the present invention, shown with a cushion placed in a first position to provide a seat;

FIG. 2 is a partially fragmented top plan view of the combination carrying case and beach accessory illustrated in FIG. 1, wherein the cushion has been pivoted into a second position to uncover a plurality of storage compartments situated within the carrying case;

FIG. 3 is a bottom, rear and left side perspective view of the combination carrying case and beach accessory shown in FIG. 1, illustrating how a table is provided by simply inverting the article; and FIG. 4 is a partially exploded and partially fragmented top, rear and right side perspective view of the combination carrying case and beach accessory of FIGS. 1-3, shown with a flexible mat extending outwardly therefrom and the cushion placed in its second position to provide a pillow, and further illustrating an insulated lid placable over an insulated compartment.

DETAILED DESCRIPTION OF THE PREFERRED EMBODIMENT

As shown in the drawings for purposes of illustration, the present invention is concerned with an improved beach accessory, generally designated in the accompanying drawings by the reference number 10. The beach accessory 10 comprises, generally, a carrying case 12 which provides a main supporting structure for the beach accessory, a flexible mat 14 stored within the carrying case, and a cushion 16 pivotally attached to the carrying case.

In accordance with the present invention, the carrying case 12 is preferably a single molded plastic article which is generally U-shaped and includes a base portion 18 and two laterally spaced carrying handles 20 and 22 extending upwardly from opposite ends of the base portion 18. The base portion 18 provides a plurality of storage compartments 24 accessible through respective upper openings.

At least one of the storage compartments 24*a* is thermally insulated and is provided with a thermally insulated lid 26 to provide a storage compartment for cooled food and drink items, such as the illustrated beverage cans 28. Of course the entire carrying case 12 can be constructed of a thermally insulating material so that each of the storage compartments 24 are suitable for the storage of cooled food items. Another storage compartment 24*b* is provided for storing miscellaneous items such as a comb 30, bottles 32, lip balm 34 and/or a tube of sunscreen 36. A third storage compartment 24*c* houses the flexible mat 14.

Underlying the storage compartments 24 in the base portion 18 is a generally planar base 38 which, when the beach accessory 10 is inverted, provides a table top for a user. As illustrated in FIG. 3, when the beach accessory 10 is inverted, the carrying handles 20 and 22 function as table legs which provide means for spacing the cushion 16 from an underlying ground surface. The carrying case 12 further includes a first vertical side 40 having a slot 42 therein through which the flexible mat 14 extends. A second vertical side 44 supports a first portion of a clasp 46 which is utilized to hold the cushion 16 in a first position.

The flexible mat 14 is stored within a third storage compartment 24*c* and is extendable therefrom through the slot 42 provided in the first vertical side 40 of the carrying case 12. The flexible mat 14, which is preferably a towel, is wound about a shaft 48 rotatably positioned within the third storage compartment 24*c*. The shaft 48 is of the self-winding type which permits the mat 14 to be extended outwardly from the carrying case 12 and locked in the extended position, and then subsequently automatically rewound onto the shaft 48 by pulling outwardly on the mat to activate a rewind spring (not shown). The flexible mat 14 includes an enlarged end 50 which is incapable of passing through the slot 42. As shown in FIG. 1, the towel-like mat 14 has an end thereof sewn to accommodate a dowel 52 which forms the enlarged end 50.

A pair of hinges 54 pivotally attach one side of the cushion 16 to the first vertical side 40 of the carrying case 12 above the slot 42. When so attached, the cushion 16 is rotatable between two primary positions. In the first position (shown in FIGS. 1 and 3) the cushion lies atop an upper surface 56 of the base portion 18 of the carrying case 12 to provide a cover for the storage compartments 24 and a seat for a user of the beach accessory 10. In the second position (illustrated in FIGS. 2 and 4), the cushion 16 rests, at least partially, on or adjacent to a ground surface to provide a pillow for the user of the beach accessory 10. Normally, in the second position the cushion 16 will rest against the extended flexible mat 14, which lies directly over the ground surface. However, the cushion 16 can be pivoted into its second position and rest directly on the ground surface without first having extended the flexible mat 14 from the third storage compartment 24*c*. The cushion 16 is held in the first position adjacent to the upper surface 56 of the carrying case 12 by the clasp 46.

A radio/cassette tape player unit 58 is positioned within the first carrying handle 20. The controls of the radio/tape player unit 58 are positioned adjacent to an exterior surface of the first carrying handle 20, and an antenna 60 extends outwardly from the second vertical side 44 of the carrying case 12. The antenna 60 is of the telescoping type so that it may be substantially enclosed within the first carrying handle 20 when transporting the beach accessory 10, and extended therefrom (see FIG. 1) when the radio/tape player unit 58 is in use.

Similarly, the second carrying handle 22 supports an alarm clock 62 adjacent to an exterior surface thereof. The alarm clock 62 is preferably hinged to the second carrying handle 22 such that the alarm clock can be pivoted outwardly (as shown in FIG. 4) to facilitate viewing thereof, or pivoted inwardly (FIG. 2) when the beach accessory 10 is being transported.

Prior to leaving on a trip to a beach or picnic area, a user of the beach accessory 10 would normally place desired food and other items in the first two storage compartments 24*a* and *b*. The flexible mat 14 would be wound about the shaft 48 within the third storage compartment 24*c* such that only the enlarged end 50 extended through the slot 42. After the desired items had been packed into the storage compartments 24, the lid 26 would be placed over the insulated compartment 24*a* and then the cushion 16 would be pivoted into its first position to provide a cover over the storage compartments. The cushion 16 would be held in place by means of the clasp 46. The beach accessory 10 is then ready to be carried, in much the same manner as a portable cooler, wherever the user desires. In this regard, carrying handle recesses 64 are provided in each carrying handle 20 and 22 above the cushion 16.

Once the user has arrived at the destination point, the flexible mat 14 can be extended from the carrying case 12 by simply pulling on the enlarged end 50 to provide a towel or the like for sunbathing. The cushion 16 is unclasped and pivoted into its second position to provide a pillow for the user. Food and other useful items are readily accessible as they are contained within the carrying case 12 itself.

Since it is sometimes desirable to have a relatively stable planar surface at the destination point for placing food and other items thereon, the beach accessory 10 can be quickly configured to provide such a stable platform. In order to provide a portable table for eating purposes, after the food items have been removed from the storage compartments 24, the cushion 16 is pivoted into its first position and locked into place by means of the clasp 46, and the flexible mat 14 is rewound onto the shaft 48. The beach accessory 10 is then simply inverted as shown in FIG. 3.

From the foregoing it is to be appreciated that the novel beach accessory 10 of the present invention can be constructed economically to provide a lightweight carrying case for food and other items, which is combined with a flexible mat 14 and cushion 16 to enhance the utility of the article. Food items may be readily stored in and retrieved from an insulated storage compartment 24*a*, and a radio/tape player unit 58 and alarm clock 62 are positioned within the carrying case 12 to facilitate transport of these items with the carrying case.

Although a particular embodiment of the invention has been described in detail for purposes of illustration, various modifications may be made without departing from the spirit and scope of the invention. According, the invention is not to be limited, except as by the appended claims.

I claim:

1. A beach accessory, comprising:

a carrying case including at least one storage compartment therein accessible through an upper opening;

a flexible mat stored within said at least one storage compartment and extendable therefrom through a slot provided in a first vertical side of said carrying case; and a cushion pivotally attached to said carrying case and rotatable between a first position wherein said cushion lies atop an upper surface of said carrying case to provide a cover for said at least one storage compartment and a seat for a user of said beach accessory, and a second position wherein said cushion rests, at least partially, on or adjacent to a ground surface to provide a pillow for the user of said beach accessory.

2. A beach accessory as set forth in claim 1, wherein said carrying case comprises a plurality of storage compartments accessible through respective upper openings, at least one of said storage compartments being thermally insulated and having a thermally insulated lid.

3. A beach accessory as set forth in claim 1, wherein said carrying case is generally U-shaped and includes laterally spaced, upwardly extending carrying handles between which said cushion is situated in its first position, wherein said carrying handles provide table legs and a base of said carrying case provides a table top when said beach accessory is inverted.

4. A beach accessory as set forth in claim 1, wherein said flexible mat is wound about a shaft rotatably positioned within said at least one storage compartment.

5. A beach accessory as set forth in claim 4, wherein said shaft includes spring loading means for self-winding said mat about said shaft within said at least one storage compartment.

6. A beach accessory as set forth in claim 1, wherein said flexible mat includes an enlarged end which is incapable of passing through said slot provided in said first vertical side of the carrying case, and wherein said flexible mat comprises a towel.

7. A beach accessory as set forth in claim 1, including a clasp for locking said cushion into its first position.

8. A beach accessory as set forth in claim 1, including at least one hinge for pivotally attaching one side of said cushion to said first vertical side of said carrying case above the slot.

9. A beach accessory as set forth in claim 1, including an alarm clock supported by said carrying case and positioned adjacent to an exterior surface thereof.

10. A beach accessory as set forth in claim 1, including music generation means supported by said carrying case and positioned adjacent to an exterior surface thereof.

11. A beach accessory as set forth in claim 10, wherein said music generation means comprises a radio receiver and a cassette tape player.

12. A combination carrying case and beach accessory, comprising:

a carrying case including a plurality of storage compartments accessible through respective upper openings, at least one of the storage compartments being thermally insulated and having a thermally insulated lid;

a flexible mat stored within one of the storage compartments and extendable therefrom through a slot in a first vertical side of the carrying case, the flexible mat being wound about a shaft rotatably positioned within the one storage compartment;

a cushion pivotally attached to the carrying case and rotatable between a first position wherein the cushion lies atop an upper surface of the carrying case to provide a cover for the storage compartments and a seat for a user of the beach accessory, and a second position wherein the cushion rests, at least partially, on or adjacent to a ground surface to provide a pillow for the user of the beach accessory; and a clasp for locking the cushion into its first position.

13. A combination as set forth in claim 12, wherein said carrying case is generally U-shaped and includes laterally spaced, upwardly extending carrying handles between which said cushion is situated in its first position, wherein said carrying handles provide table legs and a base of said carrying case provides a table top when the beach accessory is inverted.

14. A combination as set forth in claim 12, wherein said shaft includes spring loading means for self-winding said mat about said shaft within said at least one storage compartment.

15. A combination as set forth in claim 12, wherein said flexible mat includes an enlarged end which is incapable of passing through said slot provided in said first vertical side of said carrying case, and wherein said flexible mat comprises a towel.

16. A combination as set forth in claim 12, including an alarm clock supported by said carrying case and positioned adjacent to an exterior surface thereof, and music generation means supported by said carrying case and positioned adjacent to an exterior surface thereof, wherein said music generation means comprises a radio receiver and a cassette tape player.

17. A combination carrying case and beach accessory, comprising:

a carrying case including a plurality of storage compartments accessible through respective upper openings, at least one of the storage compartments being thermally insulated and having a thermally insulated lid, wherein the carrying case is generally U-shaped and includes laterally spaced, upwardly extending carrying handles and an underlying base, wherein the carrying handles provide table legs and the base provides a table top when the combination is inverted;

a flexible mat stored within one of the storage compartments and extendable therefrom through a slot provided in a first vertical side of the carrying case, the flexible mat being wound about a shaft rotatably positioned within the one storage compartment, the shaft including spring loading means for self-winding the mat about the shaft within the one storage compartment, wherein the flexible mat includes an enlarged end which is incapable of passing through the slot provided in the first vertical side of the carrying case;

a cushion pivotally attached to the carrying case and rotatable between a first position wherein the cushion lies atop an upper surface of the carrying case between the carrying handles to provide a cover for the storage compartments and a seat for a user of the combination, and a second position wherein the cushion rests, at least partially, on or adjacent to a ground surface to provide a pillow for the user of the combination; and a clasp for locking the cushion into its first position.

18. A combination as set forth in claim 17, including an alarm clock supported by a first carrying handle and positioned adjacent to an exterior surface thereof, and music generation means supported by a second carrying handle and positioned adjacent to an exterior surface thereof, wherein the music generation means comprises a radio receiver and a cassette tape player.

* * * * *